US006279837B1

(12) United States Patent
Porter

(10) Patent No.: US 6,279,837 B1
(45) Date of Patent: Aug. 28, 2001

(54) REUSABLE CHEMICAL CADDIE

(75) Inventor: Barry Porter, Bridgewater, MA (US)

(73) Assignee: Enviro Caddie LLC, Brockton, MA (US)

( * ) Notice: Subject to any disclaimer, the term of this patent is extended or adjusted under 35 U.S.C. 154(b) by 0 days.

(21) Appl. No.: 09/539,001

(22) Filed: Mar. 30, 2000

(51) Int. Cl.[7] ..... B05B 9/00
(52) U.S. Cl. ..... 239/142; 239/373
(58) Field of Search ..... 239/142–144, 239/152, 337, 340, 373, 364–366, 368, 369, 372; 222/399

(56) References Cited

U.S. PATENT DOCUMENTS

| | | |
|---|---|---|
| 585,503 | 6/1897 | Black . |
| 587,890 | 8/1897 | Weaver . |
| 888,693 | 5/1908 | Bustuniza . |
| 1,733,724 | 10/1929 | Downs . |
| 1,892,535 | 12/1932 | Sanders . |
| 2,519,707 | 8/1950 | Schaffer . |
| 3,025,006 | 3/1962 | Maurath . |
| 3,042,310 | 7/1962 | Franke . |
| 3,801,015 | 4/1974 | Hayes . |
| 4,135,669 | 1/1979 | Bridges . |
| 4,154,401 | 5/1979 | Thompson . |
| 5,186,391 | 2/1993 | Roueche . |
| 5,785,245 | 7/1998 | Tedders . |

OTHER PUBLICATIONS

Alloy Products Corporation Drawing B501–0268–00, May 5, 1998, Waukesha, WI.

Spraying Systems Co. Drawing 9079, Jul. 6, 1981, Wheaton, IL.

*Primary Examiner*—Lisa Ann Douglas
(74) *Attorney, Agent, or Firm*—Thomas E. Workman, Jr.

(57) ABSTRACT

This multipurpose device for dispensing paints or chemicals replaces aerosol cans and custom equipment for spraying paint. Constructed of stainless steel, brass, and Teflon®, the reusable chemical caddie can be used to dispense solvents, paints, and a broad range of materials which will not corrode stainless steel. The reusable chemical caddie eliminates the contamination of the atmosphere with traditional propellants, utilizing compressed air as a propellant. The reusable nature of the reusable chemical caddie eliminates the contamination that results from residual toxic materials and that are invariably discarded when traditional spray cans are discarded into landfills. It is portable, and with an increased capacity as compared to traditional spray cans, is ideally suited for commercial applications.

4 Claims, 10 Drawing Sheets

REUSABLE CHEMICAL CADDIE

BACKGROUND OF THE INVENTION

1. Field of the Invention

Chemicals, solvents, and paints are traditionally distributed in aerosol cans, glass bottles, plastic bottles, or metal cans. Aerosol cans offer the advantage of permitting the material to be distributed in a precise flow and pattern, with the disadvantage of high packaging costs and a low amount of material delivered per can. Aerosol cans also tend to be easily misplaced, discarded after only a portion of the contents of the can are dispensed, and these cans are difficult to account for and are easily misplaced.

Many manufacturing and maintenance facilities utilize numerous solvents and paints in the course of their business, and utilize many different methods of distributing and accounting for these chemicals. It is not unusual to find the same solvent or chemical distributed in several different ways, with widely differing costs, in the same facility. These industries have been searching for an economical, environmentally friendly method to dispense various materials that are used within their facilities. Equipment which is safe and which provides a single solution to their needs is now available, through the invention claimed.

2. Description of Prior Art

Industry has long sought reliable and reusable equipment for dispensing chemicals and paints. Earlier inventors have solved some, but not all, of the problems facing industry. Special purpose equipment is commonplace, but there are few inventions with the flexibility to provide a single solution for dispensing solvents, paints, and other chemicals.

U.S. Pat. No. 1,733,724 provides a tank with an agitator for spraying paint. The lid of the sprayer is held in place by a plurality of bolts, prone to damage, and the unit has no handle, and is thus limited in being easily moved. It is reusable, but not easily labeled, and does not have a safety pressure relief valve, relying instead on a pressure control valve, which if improperly set, would allow the tank to become overly pressurized, and to explode. The agitating member features an integrated motor, as opposed to utilizing an electric drill to agitate the contents as needed. The agitator and dip tubes are exposed upon the removal of the lid, making them prone to damage.

U.S. Pat. No. 1,892,535 discloses a second spray painting system, equipped with a pressure relief valve which is selectively enabled. If the tank is pressurized with the valve in the "off" position, the pressure relief valve would not prevent over pressurization. In addition, the system is stationary, and not suited for dispensing chemicals or paints to their location of use.

U.S. Pat. No. 3,025,006 discloses a third spray painting system on casters for portable use, with a spray nozzle assembly designed to mix pressurized air and paint to propel a fine mist of paint. Pressure of paint fed to the nozzle is not controlled by the system, but rather is monitored by the operator by means of a gauge, and the nozzle is adjusted to compensate for the changes in pressure that occur as the tank is used and the contents are emptied.

Each of these aforementioned patents utilize a fixed motor to operate an agitation mechanism, and are purpose built for dispensing paint. The claimed invention will dispense paint, but it is not limited to dispensing paint, and can be used to dispense solvents or other chemicals. In addition, the claimed invention solves the problem of regulating the output of material so that it is under a consistent pressure, eliminating the need to constantly adjust the flow control valves in traditional paint spraying nozzles.

U.S. Pat. No. 5,785,245 discloses a backpack sprayer for distributing insect eggs in agricultural applications. This invention utilizes a pressurization system that must be engaged as material is distributed, and is purposely built for one specific function. The device utilizes a magnetically coupled agitation device, with a custom motor and a battery to supply power. It features a dispenser that merges compressed air with material to be dispensed.

U.S. Pat. Nos. 5,186,391 and 4,154,401 disclose spray units with self-contained pressurization devices, intended to dispense insecticides in the first instance, and solvents in the second. Neither device is multipurpose enough to permit the dispensing of paint or solvents, but are rather purpose built for a specific purpose. Both devices provide a handle integral to the pressurization device, and neither have a method for stirring the contents.

U.S. Pat. Nos. 4,135,669 and 3,801,015 disclose tanks on wheels with spray nozzles to dispense material under pressure. Neither have a method of stirring the contents. One device has a pressure relief valve, and the other a dedicated compressor. Neither device is suitable for delivering material at a constant pressure over an extended use.

U.S. Pat. Nos. 2,519,707; 888,693; and 587,890 disclose devices that are stationary and designed for a single purpose. None of these inventions lend themselves to a universal solution to the problem of dispensing different materials in an industrial setting.

U.S. Pat. Nos. 3,042,310 and 585,503 disclose devices that dispense a spray of material either under the power of a connected device to supply compressed air, or by generating the pressure within. These devices require adjustments as the pressure supply varies, and are not suitable for dispensing the many products in use in an industrial environment.

The existing devices are designed to solve the problem of dispensing a single material, such as paint, or do not provide the ability to dispense the product under constant pressure for the entire contents in the container. The current art discloses devices that are complicated, with integral motors that could create hazardous situations with sparks, or devices that are not portable. Current devices that are portable enough to permit the device to be lifted and carried are limited, and those available do not provide the features needed to provide a single solution to industry, in order to permit the dispensing of paints, solvents, and other materials.

SUMMARY OF THE INVENTION

The invention has a stainless steel tank with a removable and resealable lid. An integral stirring mechanism is provided, with a shaft extending beyond the tank, for the attachment of a drill or other power assisted device to turn the stirring shaft. A pressure relief valve is provided, to insure that the tank is not over-pressurized. A stainless steel flexible mesh hose permits the material dispensed to be controlled by a flow control valve, providing precise flow of material. A nozzle and release mechanism permits the dispensed material to be distributed in either a spray or a precise stream. A trigger controls the release mechanism. The mesh reinforced hose permits the operator to position the nozzle by pointing it a surface to receive the dispensed material. A molded plastic sleeve provides an integrated base, handle, and a pocket for placing a label of the tank's contents.

DESCRIPTION OF THE PREFERRED EMBODIMENT

Figure 1:
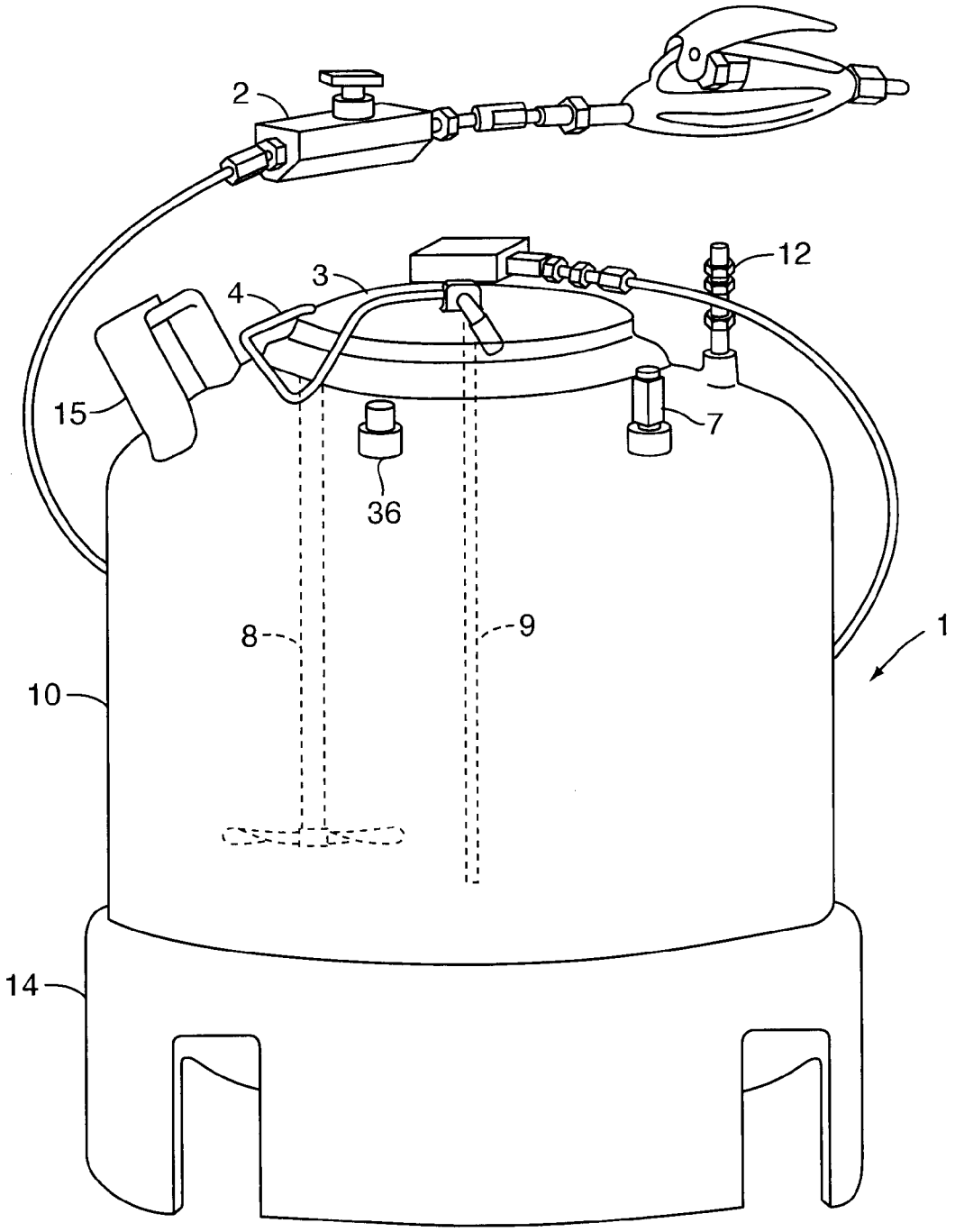
FIG. 1 shows the preferred embodiment in a perspective view from the top, showing the tank and the various connections to the top of the tank.
Figure 2:
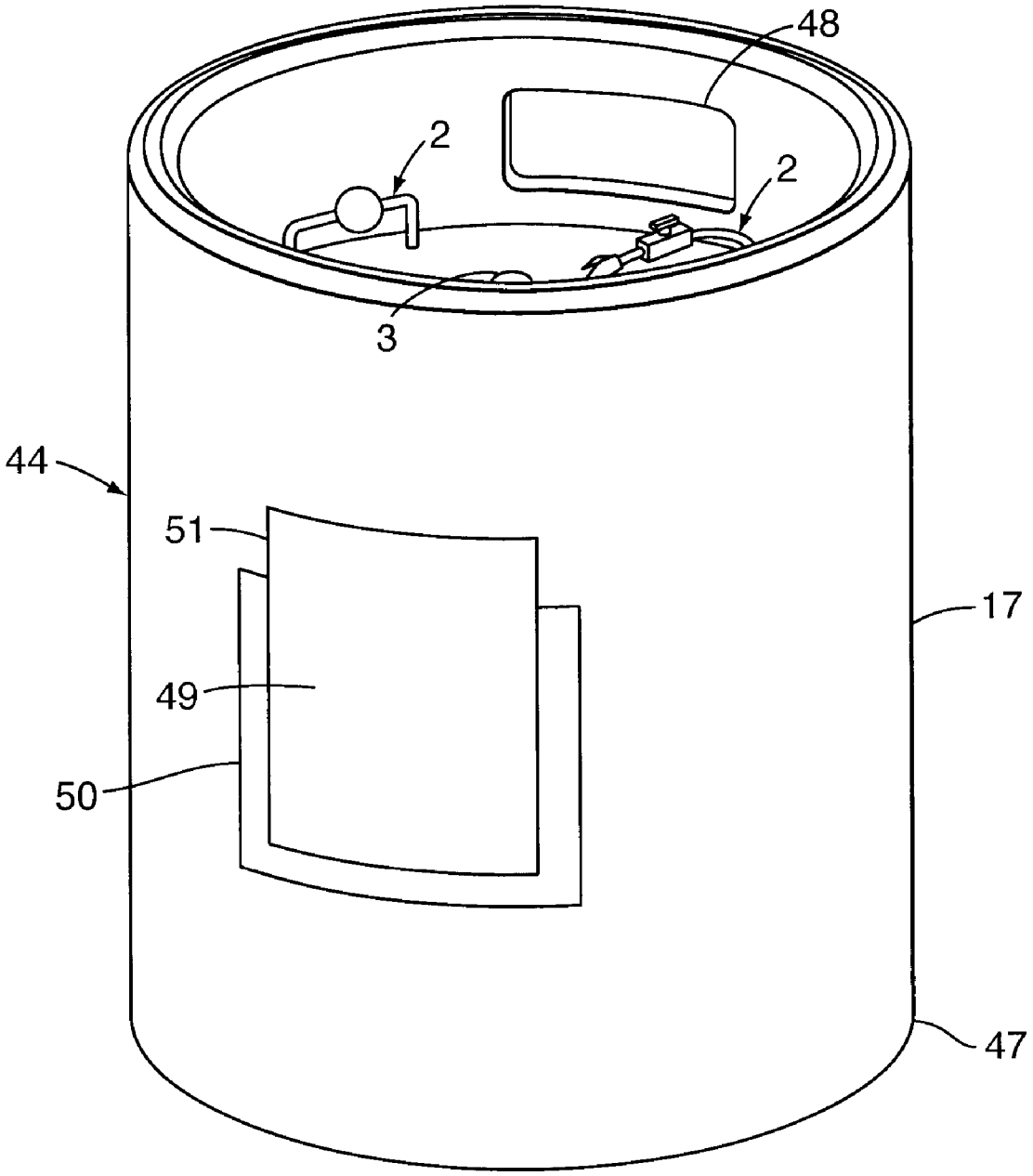
FIG. 2 shows an alternate embodiment, a version of the invention with a sheath covering the tank.
Figure 3:
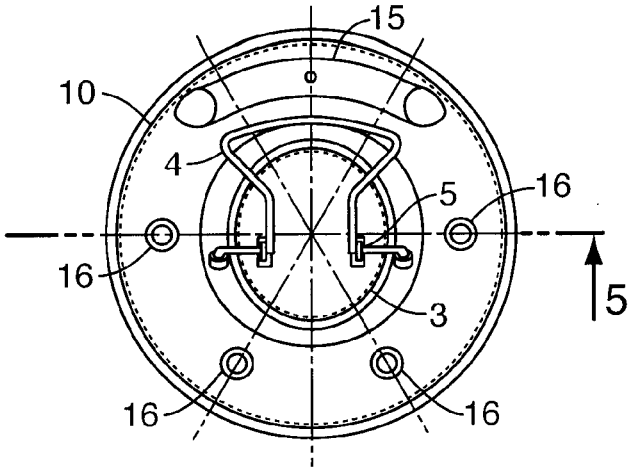
FIG. 3 shows a top view of the tank.
Figure 4:
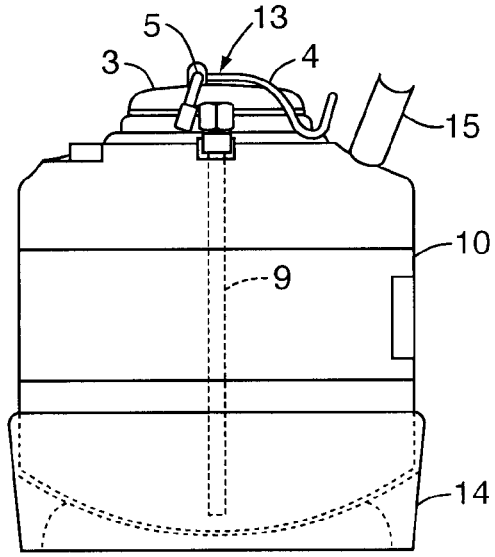
FIG. 4 shows a side view of the tank.
Figure 5:
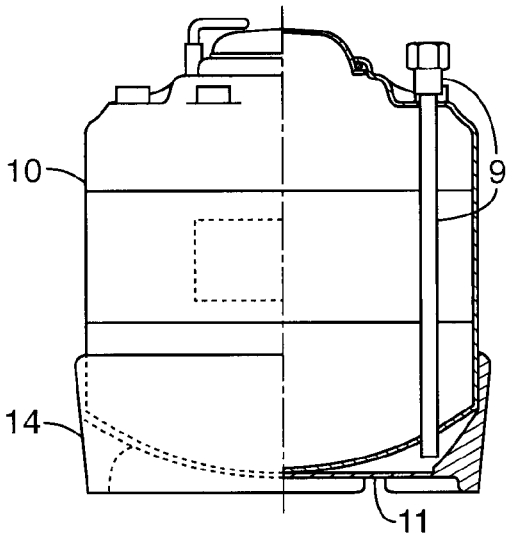
FIG. 5 shows a section view of the tank.
Figure 6:
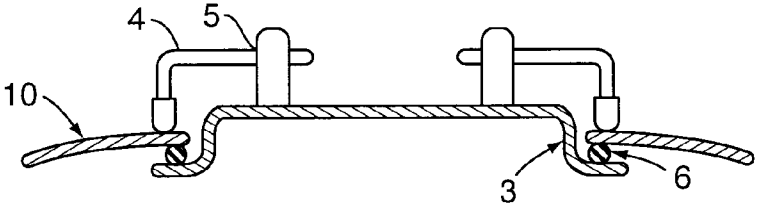
FIG. 6 shows a section view of the lid of the tank, disclosing the seal mechanism.
Figure 7:
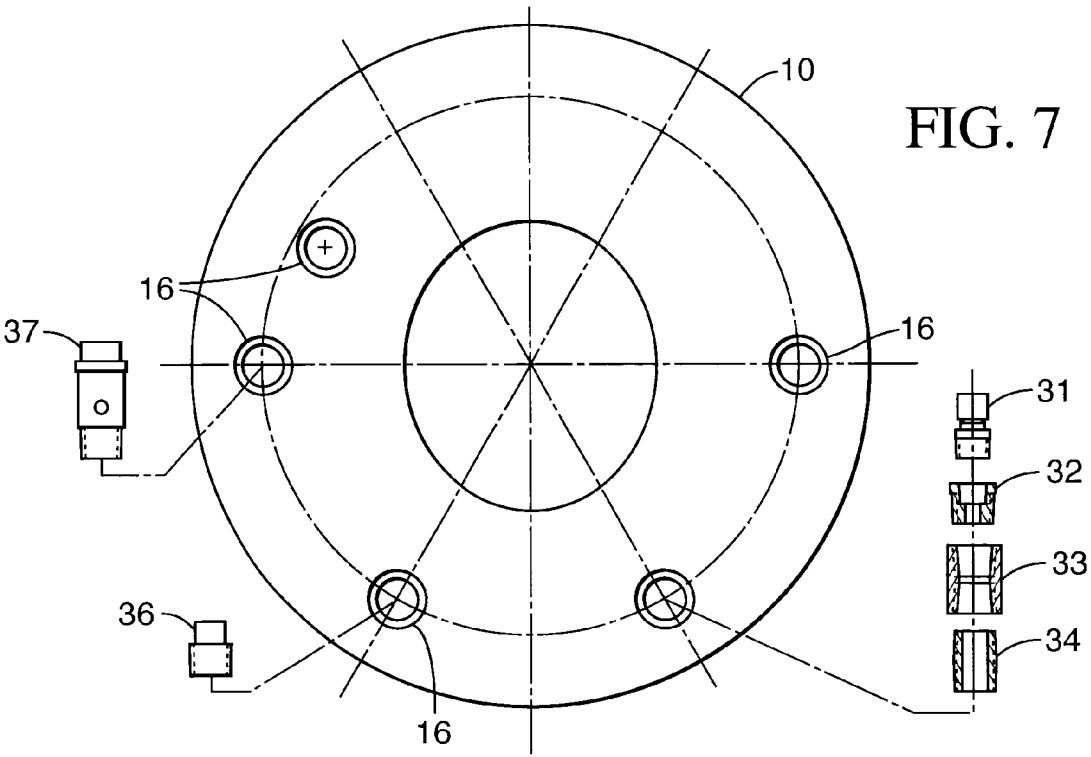
FIG. 7 shows the fittings as they are attached to the top of the tank.
Figure 8:
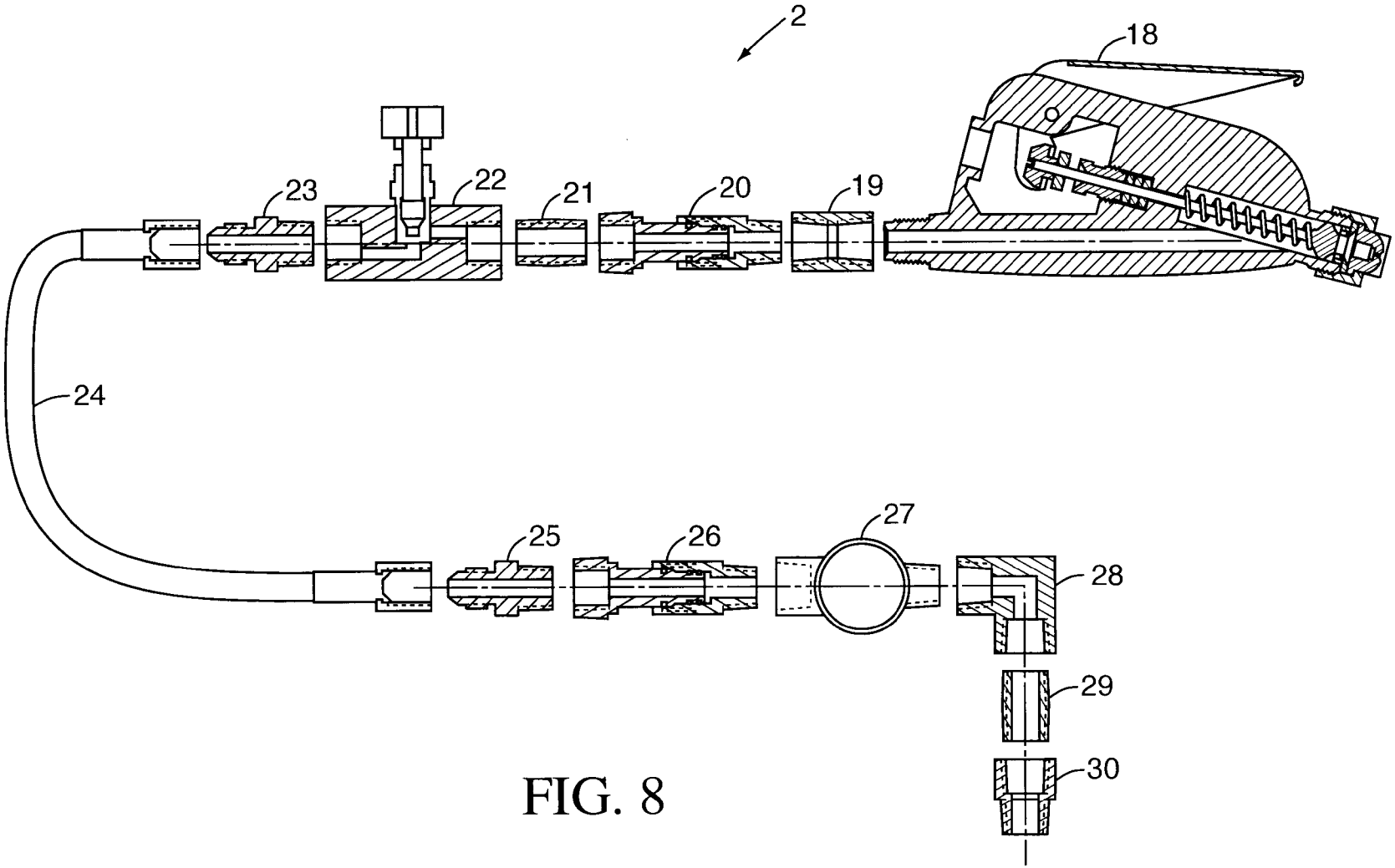
FIG. 8 shows the dispensing assembly.
Figure 9:
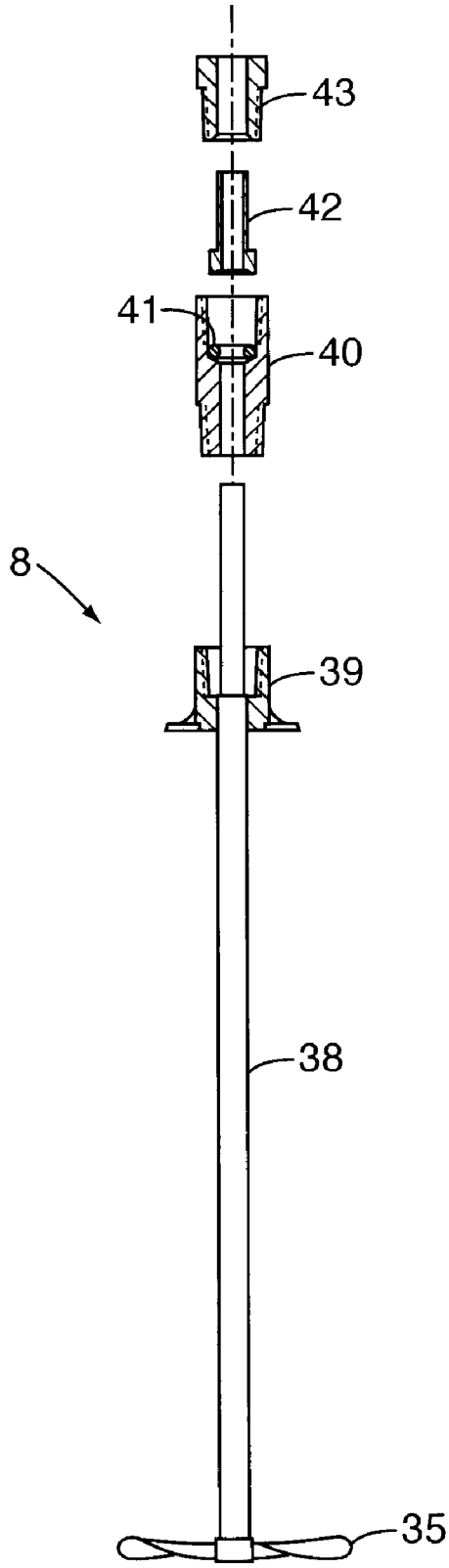
FIG. 9 shows the stirring assembly.
Figure 10:
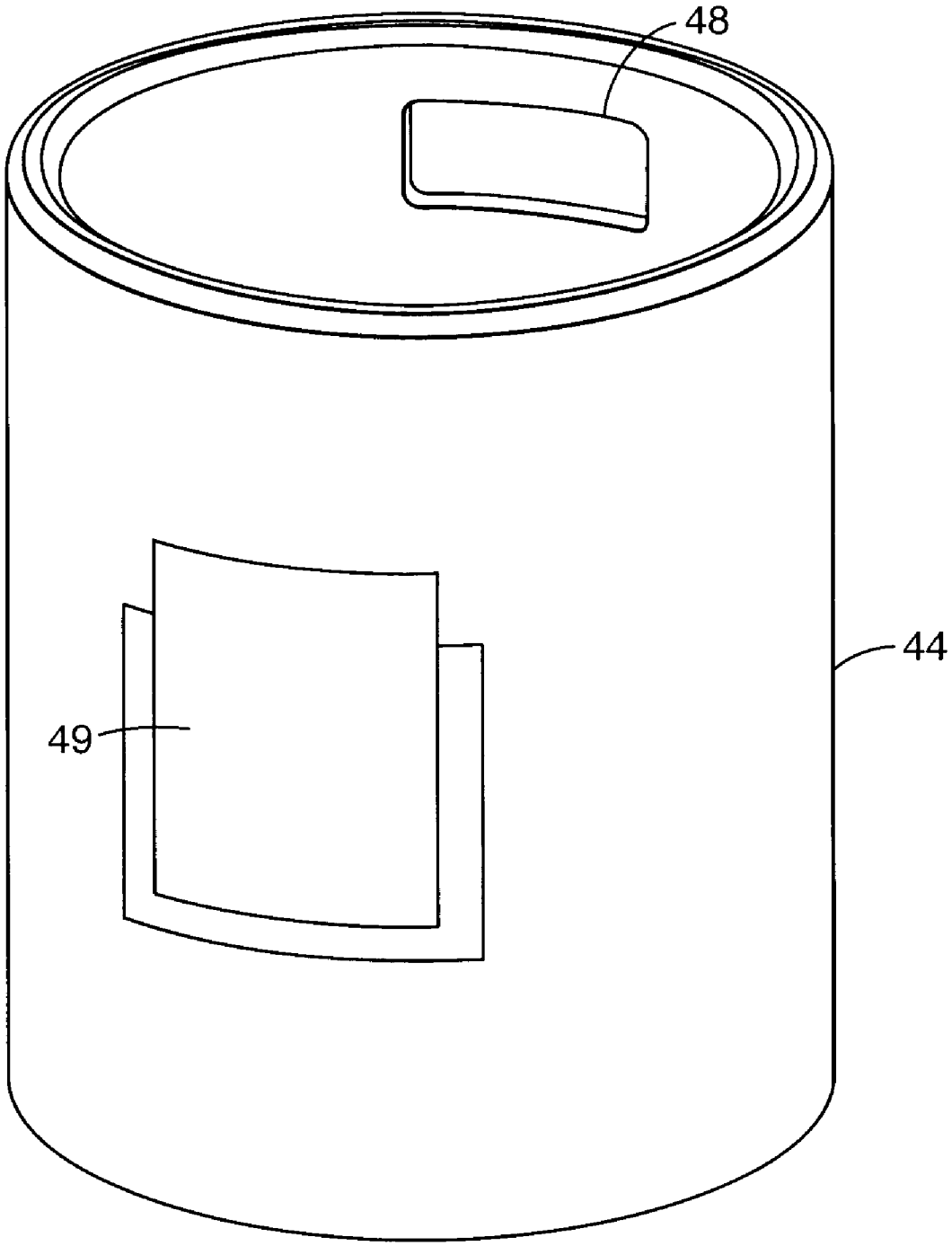
FIG. 10 shows a perspective view of the sheath.
Figure 13:
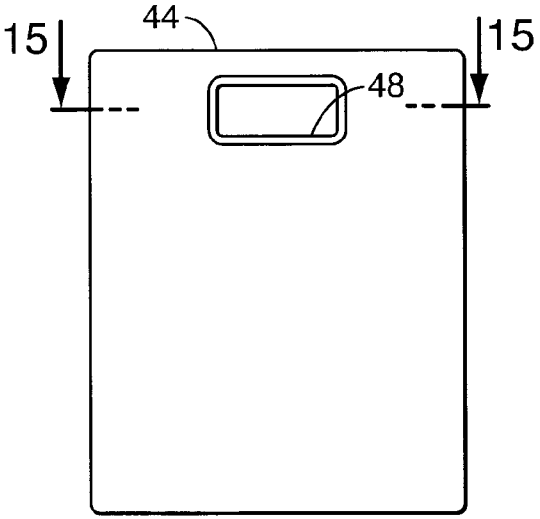
FIG. 13 shows a back view of the sheath.
Figure 12:
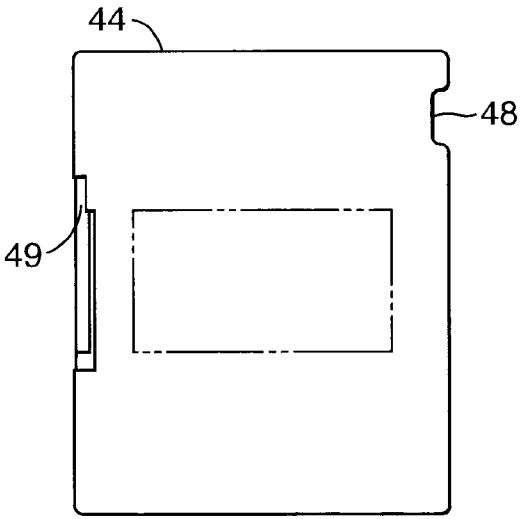
FIG. 12 shows a side view of the sheath.
Figure 11:
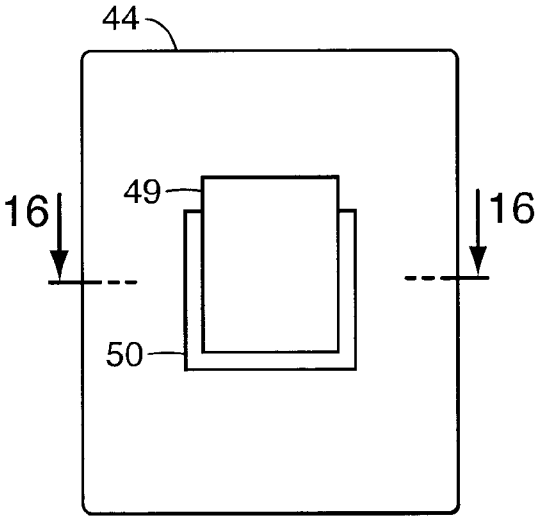
FIG. 11 shows a front view of the sheath.
Figure 14:
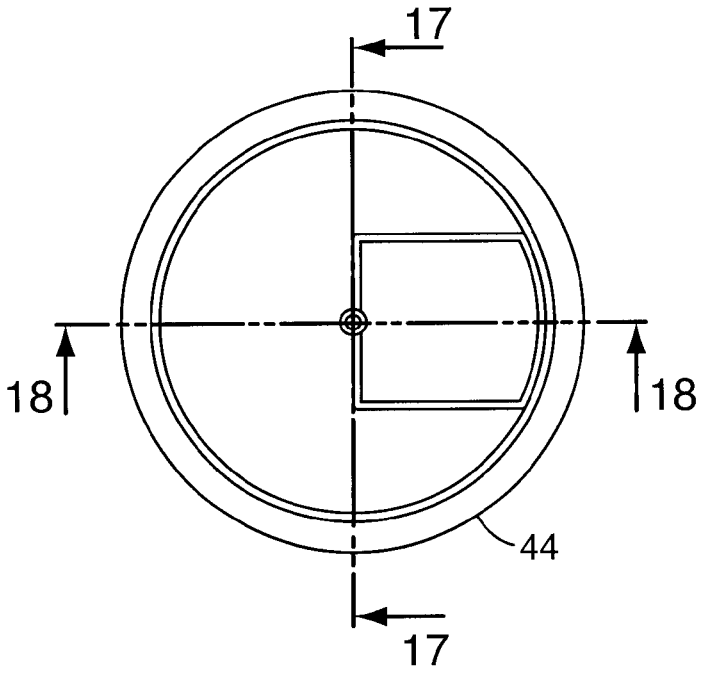
FIG. 14 shows a section view of the sheath, viewed from the top.
Figure 15:
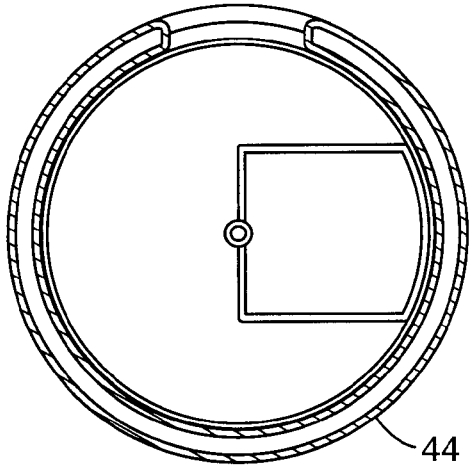
FIG. 15 shows a second section view of the sheath, viewed from the top.
Figure 16:
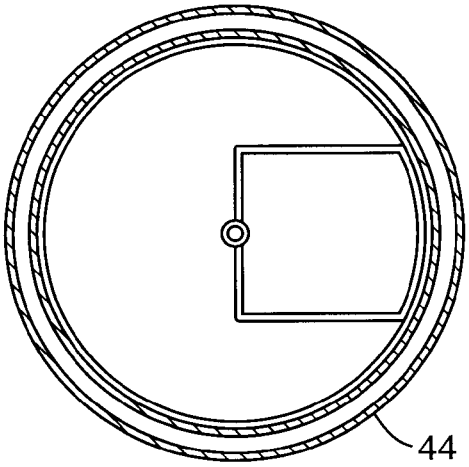
FIG. 16 shows a third section view of the sheath, viewed from the top.
Figure 18:
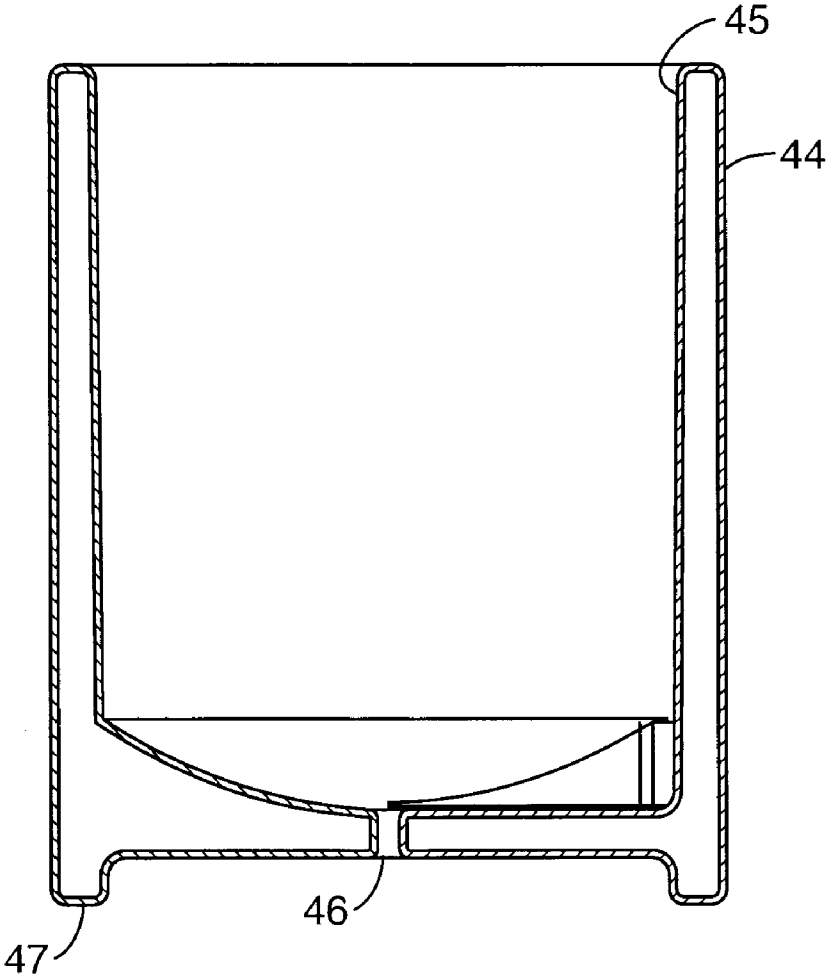
FIG. 18 shows a section view of the sheath viewed from the back.
Figure 17:
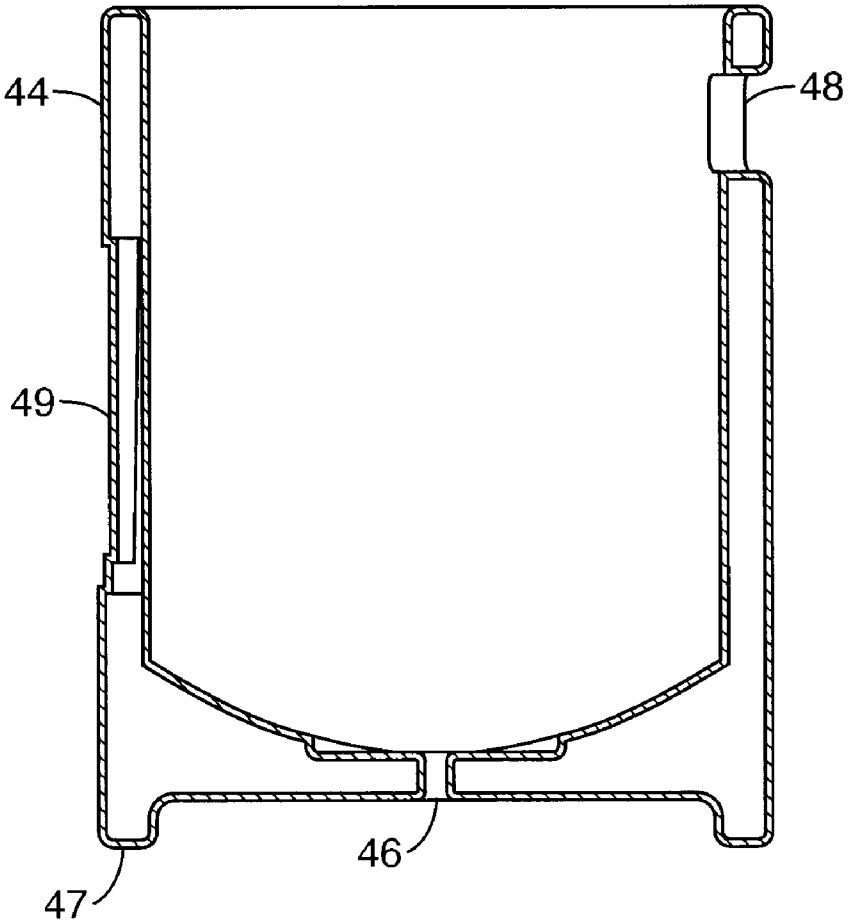
FIG. 17 shows a section view of the sheath viewed from the side.

The preferred embodiment of the invention 1 incorporates a commercially available stainless steel tank 10 which incorporates a removable and resealable lid 3 for refilling the tank with material to be dispensed. The material is held in the tank 10 under pressure, which is provided through the pressurization assembly 12. A stirring assembly 8 is provided to mix the contents of the tank, just prior to dispensing. A dispensing assembly 2 provides a means of regulating and directing the flow of dispensed material. For safety purposes, a pressure relief valve 7 is provided to insure that the tank 10 is not overpressurized.

In the preferred embodiment, the tank 10 is a two gallon ASME-code pressure tank, with a capacity of approximately two and one quarter gallons, as manufactured by Alloy Systems, of either 304 or 316L type stainless steel, with a pressure rating of one hundred fifty-five pounds. These commercially available tanks 10 have four female connections 16, for use with the pressure relief valve 7, the pressurization assembly 12, the stirring assembly 8, and the dispensing assembly 2. One of the four connections 16 is plugged with a threaded brass plug 32. The tank 10 also has an internal dip tube 9, suitable for attaching the dispensing assembly 2. The dip tube 9 is made of stainless steel, and is attached so as to be parallel to the side walls of the tank 10. The bottom of the tank 10 is equipped with a depression 11 located at the inlet of the dip tube 9, so that the dispensed material will be fed by gravity to this depression 11 in the tank 10. The standard product has an oval refill lid 3 which aligns tightly with the tank by an integral seal 6, and which is held tightly in place by a retainer clip assembly 13. To insure that the tank stays upright, a cylindrical base footing 14 is provided by the manufacturer. A handle 15 is provided to assist in moving the reusable chemical Caddie 1 to the point of use.

The oval refill lid 3 is held mechanically in place by a clip 4. The clip 4 is attached to the lid 3 at a pivot point 5, so that by swinging the handle upwards, pressure is initially increased, and then decreased so as to release the lid 3 from the Teflon® seal 6. Once released, the lid 3 can be rotated 90 degrees, tilted, and then removed from the tank 10. Once the tank 10 is refilled, the lid can be replaced by reversing the removal procedure. The lid 3 makes a mechanical connection when the clip 4 is placed in position to hold the lid 3 in place, and is further held tightly to the seal 6 by the pressure inside the tank 10.

The dispensing assembly 2 is made of Teflon®, brass, and stainless steel, using commercially available fittings, tubing, and controls. The assembly is attached to the tank 10 by means of a brass male-female adapter 30. A brass short nipple 29 is connected to the adapter 30. A brass 90 degree adapter 28 is attached to the short nipple 29. An air regulator 27, as manufactured by DeVibliss as part HAV-512A, is connected to the brass 90 degree adapter 28. A brass inline female union 26, having seals made of Teflon®, is attached to the 90 degree adapter 27. A brass male union 25 is attached to the inline female union 26. A four foot length of Teflon® tubing, with a stainless steel protecting mesh and integral couplings 24 is attached to the brass male union 25 at one end. A brass male union 23 is attached to the other end of the tubing 24. The flow control valve 22 is attached to the brass male union 23. A brass short nipple 21 is attached to the second end of the flow control valve 22 and to a brass swivel fitting 20. The brass swivel fitting 20 has seals made of Teflon®, and is attached to the spray nozzle assembly 18, by means of a brass coupling 19. The spray nozzle assembly is a commercially available unit, as provided by Spray Systems and as labeled the Gunjet 32 series.

The pressure relief assembly 7 consists of a commercially available relief valve 37 with threads suitable for attaching the valve 31 to the tank 10. The relief valve 37 remains closed at pressures below 150 pounds per square inch (PSI), and open when the pressure reaches 150 PSI, thereby preventing an inadvertent overpressurization of the tank 10.

The pressurization assembly 12 permits air, or any other propellant, 5 to be placed into the tank. The assembly 12 consists of a brass short nipple 34 with threads suitable for inserting into the tank 10, into one of the four female connections 16. A brass coupling 33 connects the short nipple 34 to a brass reducer 32. The Brass air supply valve 31 screws into the brass reducer 32. A source of compressed air mates with the air supply valve 31, permitting the tank 10 and its contents to be pressurized to a pressure not to exceed 150 PSI.

The stirring assembly 8 consists of an agitator in the form of a propeller 35 attached to a stainless steel shaft 38. The shaft 38 is of a length that permits the propeller 35 to mix the contents of the tank 10 when a minimal amount of material is in the tank 10, without touching the bottom of the tank 10. The shaft is 0.250 inch in diameter. In the two gallon tank 10, the shaft 38 is 8.125 inches long, and the propeller 35 has two blades, which measure two inches, tip to tip. The propeller 35 is welded to the shaft 38. The shaft 38 passes through a port 39, which is welded to the tank 10 using stainless fill rod or wire. The port 39 provides a channel for the shaft 38 which is set at an angle of fifteen degrees, so that the shaft 38 is directed to the center of the tank 10, to the lowest point in the tank 10. The port 39 has a female threaded end, into which a male/female swivel 40 is threaded. The swivel 40 has a cylindrical bore into which a Teflon® O-Ring 41 is inserted, the diameter of the bore being 0.375 inches, and the O-Ring 41 being 0.1 inch in cross section diameter, and 0.375 inches measured from outer edge to outer edge, so that the O-Ring 41 fits snugly into the cylindrical bore. A compression seal retainer 42 is inserted into the cylindrical bore of the swivel 40, and is compressed by means of a compression screw 43, so that the O-Ring 41 makes a pressure tight seal around the shaft 38.

The invention 1 is most effectively used when the pressure regulator is set to 40 PSI, the tank is filled to two thirds capacity (up to one and a half gallons of chemical, paint or solvent to be dispensed, in a two and a quarter gallon tank 10), and the tank is pressurized to 110 PSI. When so configured, the invention will deliver a consistent and steady flow of product from the first dispensed, to the last dispensed, leaving little, if any, residual product. This is particularly important in applications that involve the nozzle 18 configured to spray a pattern of material, so that the pattern is consistent throughout the use of the product.

The following brass fittings are ¼ NPT: coupling 19, swivel fitting 20, short nipple 21, male union 23, male union 25, inline female union 26, 90 degree elbow 28, short nipple 29, male-female adapter 30, air supply valve 31, coupling 33, short nipple 34, plug 36, port 39, male/female swivel 40, and compression screw 43.

In a second preferred embodiment 17, the tank 10 is housed and protected in a sheath 44. The sheath 44 has an interior cylindrical wall 45 with an inward tapering wall, so that the tank 10 fits snugly in the sheath 44. A small opening 46 in the base of the sheath permits the tank 10 to be inserted tightly, and prevents the compression of air between the tank 10 and the sheath 44 when the tank 10 is inserted into the sheath 44. Once so inserted, the opening 46 is filled with an epoxy, to form a permanent seal and to prevent the tank 10 from being removed from the sheath 44. The height of the sheath 44 is configured so as to permit the coiled dispensing assembly 2 to be coiled and placed wholly within the sheath 44, eliminating the need for a bracket to hold the dispensing assembly 2 and tubing 24.

In the second embodiment, the cylindrical stainless steel footing 14 is removed and replaced with an integral footing 47 molded as part of the sheath 44. The handle 15 is removed and replaced with an integrally molded handle 48 in the sheath. The sheath 44 is equipped with a blind pocket 49, recessed into the sheath 44 so that a clear cover 50 is permanently affixed to the sheath 44 to form a pocket into which a label card 51 may be inserted, to identify the contents of the Reusable Chemical Caddie 1.

I claim:

1. A reusable chemical caddie consisting of:

A. a cylindrical stainless steel tank made of type 304 or 316L stainless steel;

B. said tank having a top surface positioned opposite a base of said tank;

C. said tank having an oval shaped opening in the top surface;

D. said tank having a seal integrally affixed to said opening;

E. said tank having a lid which fits tightly into said opening;

F. said tank having an attachment mechanism affixed to the top surface, so that in a first position the lid is held tightly to the integrated seal, and in a second position, the lid may be removed to permit the tank to be filled with a liquid material;

G. said tank having at least four threaded connections in said top surface, into which the following assemblies are affixed:
   i. a dispensing assembly,
   ii. a pressure relief assembly,
   iii. a stirring assembly,
   iv. a pressurization assembly;

H. said dispensing assembly consisting of:
   i. an internal dip tube attached to one of the threaded connections, extending to the bottom of said tank,
   ii. a first set of brass connectors attached to the threaded connection connected to said dip tube,
   iii. a pressure regulator attached to the first set of brass connectors,
   iv. a length of Teflon® tubing, enmeshed in stainless steel, with couplings to affix a first end to said pressure regulator,
   v. a second set of brass connectors, attached on one end to the Teflon® tubing,
   vi. a flow control valve, having an inlet and an outlet, connected to said inlet to said second set of brass connectors,
   vii. a third set of brass connectors, attached to said outlet of said control valve,
   viii. a nozzle assembly with release mechanism, said assembly having an adjustable nozzle which controls the pattern of material discharged from said nozzle;

I. said pressure relief assembly being constructed so as to release pressure from said tank whenever the pressure exceeds a value that is less than or equal to the rated value of said tank;

J. said stirring assembly consisting of:
   i. an agitator,
   ii. a shaft, onto which the agitator is attached at a first end,
   iii. a port, which is permanently affixed to said tank, and through which the shaft passes,
   iv. a swivel seal assembly, attached to said port; and, K. said swivel seal assembly consisting of:
   i. a threaded swivel assembly with a cylindrical opening,
   ii. said cylindrical opening being threaded at the outer end and having smooth walls at the interior end,
   iii. said swivel seat having an O-Ring which fits snugly within the cylindrical opening, through which the shaft passes snugly,
   iv. said O-Ring having a compression fitting and compression screw which compress the O-Ring against the shaft, forming a seal of sufficient strength to withstand the pressure of said tank.

2. A reusable chemical caddie as in claim 1, further comprising:

A. a base being cylindrical in shape, said base having one edge attached to said tank and a second edge which forms a support which holds said tank in a vertical position when said base is rested on a level surface; and, B. a handle, said handle being attached to the top surface of said tank so that said tank can be easily moved from place to place by a human operator.

3. A reusable chemical caddie as in claim 1, further comprising:

A. a molded sheath, having a cylindrical shape with a floor positioned and molded to fit the shape of the curved bottom of the tank;

B. said molded sheath having sides that are sloped so as to narrow to a diameter that creates a snug fit with said tank, when said tank is fully inserted into said sheath;

C. a pressure relief opening in the bottom of said sheath, positioned to allow the air between the tank and the sheath to be expelled as the tank is inserted into the sheath;

D. a seal, made of an epoxy sealer, which fills the relief opening after the tank is inserted into the sheath, in order to prevent the removal of the tank from the sheath;

E. a handle, molded into the sheath by removing a rectangular shaped section of material from the sheath, in the uppermost wall of the sheath, so as to form an opening suitable for a human hand to lift and move the sheath and tank;

F. a base, formed by the extension of the cylindrical wall below the floor of said sheath;

G. a storage area for the dispensing assembly, formed by an extension of said cylindrical wall above the top of said tank, so that the dispensing assembly can be coiled and placed wholly within the area defined by the storage area;

H. a blind pocket formed within the molded sheath, having a transparent cover that is permanently affixed to a recessed portion of the outer wall of said sheath on a bottom edge and two side edges, the top of said cover forming a slot;

I. said recessed portion molded into said sheath behind said transparent cover;

J. a label, inserted into said recessed area; and,

K. said molded sheath being molded of a plastic material with a UL flammability rating of 94HB or better.

4. A reusable chemical caddie as in claim 3, in which:

A. said tank has a two gallon capacity;

B. said molded sheath has the trademark name "Enviro Caddie" molded into the side of the outer wall of the sheath, in relief characters;

C. said Pressure Regulator is set to 40 pounds per square inch;

D. said Pressure Relief assembly is set to release at 150 pounds per square inch;

E. said Teflon® tubing is four feet in length;

F. said molded sheath is manufactured utilizing cylindrical molding techniques, so that the walls of the sheath have a nominal thickness of 0.09 inches; and, G. said molded sheath is constructed of MRP 105 LLDPE, in a material with a green color suggestive of environmental friendliness.

* * * * *